US008135320B2

(12) United States Patent
Matsumoto et al.

(10) Patent No.: US 8,135,320 B2
(45) Date of Patent: Mar. 13, 2012

(54) IMAGE FORMING APPARATUS

(75) Inventors: Shogo Matsumoto, Yokohama (JP); Akira Asaoka, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 256 days.

(21) Appl. No.: 12/555,359

(22) Filed: Sep. 8, 2009

(65) Prior Publication Data

US 2010/0061777 A1 Mar. 11, 2010

(30) Foreign Application Priority Data

Sep. 8, 2008 (JP) ..... 2008-229306

(51) Int. Cl.
*G03G 15/16* (2006.01)

(52) U.S. Cl. ..... 399/316; 399/268; 271/264; 271/272

(58) Field of Classification Search ..... 399/268, 399/316; 271/264, 272
See application file for complete search history.

(56) References Cited

U.S. PATENT DOCUMENTS

| | | | | |
|---|---|---|---|---|
| 5,692,744 | A * | 12/1997 | Funato | 271/242 |
| 6,101,361 | A * | 8/2000 | Karashima et al. | 399/316 |
| 6,188,863 | B1 * | 2/2001 | Gross et al. | 399/316 |
| 7,630,673 | B2 * | 12/2009 | Michishita | 399/316 |
| 7,929,895 | B2 * | 4/2011 | Tsuchiya | 399/316 |
| 2003/0039488 | A1 * | 2/2003 | Fayette et al. | 399/316 |
| 2003/0086733 | A1 * | 5/2003 | Sawai et al. | 399/302 |
| 2006/0198669 | A1 * | 9/2006 | Ohba | 399/316 |
| 2007/0269242 | A1 * | 11/2007 | Hattori et al. | 399/316 |
| 2007/0297829 | A1 * | 12/2007 | Kurosu et al. | 399/121 |
| 2009/0208257 | A1 | 8/2009 | Matsumoto | |

FOREIGN PATENT DOCUMENTS

| | | |
|---|---|---|
| JP | 2004-115266 | 4/2004 |
| JP | 2006-139168 | 6/2006 |
| JP | 2008-134387 | 6/2006 |
| JP | 2006-248730 | 9/2006 |
| JP | 2006248730 A * | 9/2006 |
| JP | 2008-3447 | 1/2008 |
| JP | 2008-39840 | 2/2008 |
| JP | 2008-58593 | 3/2008 |

* cited by examiner

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

An image forming apparatus for transporting a recording medium on which an image is formed includes a guide plate. The guide plate guides the recording medium to a predetermined position in the image forming apparatus and includes a flexible sheet member and a rigid holding member. The rigid holding member holds the flexible sheet member such that the flexible sheet member projects from a front end of the rigid holding member. The projecting portion of the flexible sheet member includes at least three flexible sub-portions having a different bend-stiffness per unit area from each other, and the bend-stiffness per unit area is reduced toward a downstream side in a sheet guide direction.

5 Claims, 6 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2008-229306 filed on Sep. 8, 2008 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, and a printer, and more particularly, to a sheet guide member that guides a recording medium in an image forming apparatus.

2. Description of the Background Art

In general, in an image forming apparatus, a recording medium such as a sheet of paper on which an image is to be formed is guided through the image forming apparatus by one or more guide members. For example, a pair of guide plates is used to guide the recording medium to a transfer position at which a toner image, already formed on a surface of an image bearing member such as a photoreceptor or an intermediate transfer body, is transferred onto the recording medium.

During this transfer process, it is known that image defects tend to occur substantially at the end portion of the recording medium in the longitudinal direction. The image defect that occurs at the end portion of the recording medium because immediately after the trailing edge of the recording medium passes the upper guide plate, the trailing edge of the recording medium hits the belt-type intermediate transfer body, delivering an undesirable impact thereto that causes the recording medium to flap and thus causes toner constituting the toner image on the belt-type intermediate transfer member to scatter.

Various approaches have been proposed in an attempt to solve this problem. For example, one related-art image forming apparatus includes an approach guide plate to guide the recording medium to the transfer position of a belt-type intermediate transfer member. The toner image formed on the belt-type transfer member is then transferred onto the recording medium. The approach guide plate includes an upper guide plate and a lower guide plate. The upper guide plate is placed obliquely with respect to a transport direction of the belt-type intermediate transfer body. The upper guide plate includes a sheet member at the front end thereof so as to reduce the above-described impact of the intermediate transfer body against the recording medium.

With this configuration, image defects such as rear-end scattering or lateral-line scattering of the toner image can be prevented. As a result, it is possible to form a good toner image free of image defects on the recording medium. In particular, when an image is formed on a recording medium with some rigidity, such as a postcard, a good, defect-free toner image can be formed.

However, in such a related-art image forming apparatus, an amount of projection of the sheet member from the front end of the upper guide member is greatest at the center in the width direction, and gradually recedes toward the lateral edges in the width direction. Consequently, depending on the material of the sheet member, in particular when the recording medium is relatively rigid, it is difficult for the guide member including the sheet member to adequately suppress image defects at the end portion of the recording medium. Furthermore, image defects are still generated at the leading end of the recording medium.

Moreover, in terms of reducing the impact of flapping of the recording medium, material having relatively low bend-stiffness is suitable for the sheet member at the front end of the upper guide plate. It is known, however, that if the bend-stiffness of the sheet member is too low, a relatively rigid recording medium causes undesirable image degradation at the leading end of the recording medium. This is because the front end of such a relatively rigid recording medium advances to the belt-type intermediate transfer member while pushing and bending the sheet member. The recording medium, then, hits the belt-type intermediate transfer member. Immediately after that, flapping of the recording medium causes the toner constituting the toner image on the belt-type intermediate transfer member to scatter.

Conversely, in order to reduce undesirable image degradation at the leading end of the recording medium, it is desirable to use material having relatively high bend-stiffness for the sheet member.

Thus, as described above, the bend-stiffness of the material for the sheet member needs to be different for correcting image degradation at the leading end of the recording medium and image degradation at the trailing edge of the recording medium on the other.

The foregoing description pertains to problems relating to the guide member that guides the recording medium from the belt-type intermediate transfer body to a transfer position inside the image forming apparatus. Similar problems occur when the guide member guides the recording medium from a belt-type photoreceptor to the transfer position. Furthermore, similar problems occur when the guide member guides the recording medium from a drum-type image bearing member to the transfer position. Still further, immediately after the trailing edge of the recording medium passes through and becomes free of the guide member, when the position of the trailing edge of the recording medium changes substantially to the image bearing member side, image defects tend to occur. In addition, even if the trailing edge of the recording medium moves away from the image bearing member, problems still occur. This is because, for example, rapid positional change of the trailing edge of the recording medium causes flapping of the recording medium, generating vibration. Vibration adversely affects optical writing by an exposure unit in the image forming apparatus.

For reasons described below, not only the guide member of the image forming apparatus using the transfer method as described above but also the guide member of an image forming apparatus using a direct-recording method may not prevent undesirable vibration due to flapping of the recording medium.

Referring now to FIG. 11, there is provided a cross-sectional view of one example of a secondary transfer portion of a related-art image forming apparatus.

As illustrated in FIG. 11, the recording medium P is sandwiched between a transfer roller 131 and an opposing roller 132 in the secondary transfer portion, and between a pair of registration rollers 154. Because peripheral velocities of the pair of registration rollers 154 and the transfer roller 131 are different, the recording medium is deformed (bent) after the recording medium P is sandwiched between the transfer roller 131 and the opposing roller 132.

The apparatus further includes an upper guide member 161 located between the transfer roller 131 and the opposing roller 132, and the pair registration rollers 154. An end portion hj of the upper guide member 161 at a transfer nip side between the transfer roller 131 and the opposing roller 132 is positioned closer to the opposing roller 132 than to the transfer roller 131 with respect to a straight horizontal line L connected a registration nip between the registration rollers 154 to the transfer nip. A transfer guide roller 133 is provided in the inner loop of an intermediate transfer belt 120 and in the vicinity of the upstream of the opposing roller 132 in the direction of rotation of the belt.

With the configuration described above, there is no device to prevent the recording medium P from deforming toward the opposing roller 132. Furthermore, as the distance between the transfer nip portion where the transfer roller 131 and the opposing roller 132 meet and press each other and the end portion hj increases, the amount of the recording medium P between the nip portion and the end portion hj also increases and the rigidity of the recording medium P at this area decreases. As a result, the recording medium P deforms between the transfer nip portion and the end portion hj of the upper guide member 161 due to the difference in a peripheral velocity of the pair of the registration rollers 154 and the transfer roller 131 described above. When the recording medium P deforms, the recording medium P may contact the intermediate transfer belt 120. In this state, the recording medium P is immediately before being nipped by the transfer roller 131 or the opposing roller 132. The contact condition between the recording medium P and the intermediate transfer belt 120 is unstable, causing scattering of the toner constituting the toner image.

SUMMARY OF THE INVENTION

In view of the foregoing, in one illustrative embodiment of the present invention, an image forming apparatus for transporting a recording medium on which an image is formed includes a guide plate. The guide plate guides the recording medium to a predetermined position in the image forming apparatus and includes a flexible sheet member and a rigid holding member. The rigid holding member holds the flexible sheet member such that the flexible sheet member projects from a front end of the rigid holding member. The projecting portion of the flexible sheet member includes at least three flexible sub-portions having a different bend-stiffness per unit area from each other, and the bend-stiffness per unit area is reduced toward the downstream side in a sheet guide direction.

In another illustrative embodiment of the present invention, an image forming apparatus for transporting a recording medium on which an image is formed includes an image bearing member, a transfer member, a guide plate, and a sheet feeding device. The image bearing member bears an image. The transfer member transfers the image onto the recording medium. The guide plate guides the recording medium substantially from the image bearing member side to a transfer position between the image bearing member and the transfer member and includes a flexible sheet member and a rigid holding member. The rigid holding member holds the flexible sheet member such that the flexible sheet member projects from a front end of the rigid holding member. The sheet feeding device provided substantially at the upstream side in a direction of sheet transport of the guide plate sends the recording medium. The projecting portion of the flexible sheet member includes at least two flexible sub-portions having a different bend-stiffness per unit area from each other. The bend-stiffness per unit area is reduced toward the downstream side in a sheet guide direction. The tip of the sheet member is located opposite the image bearing member via a hypothetical sheet transport path that assumes that the recording medium is linearly transported to the guide plate by the sheet feeding device. The tip of one of the flexible sub-portions closest to the holding member is on the sheet transport path or substantially at the image bearing side from the sheet transport path.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
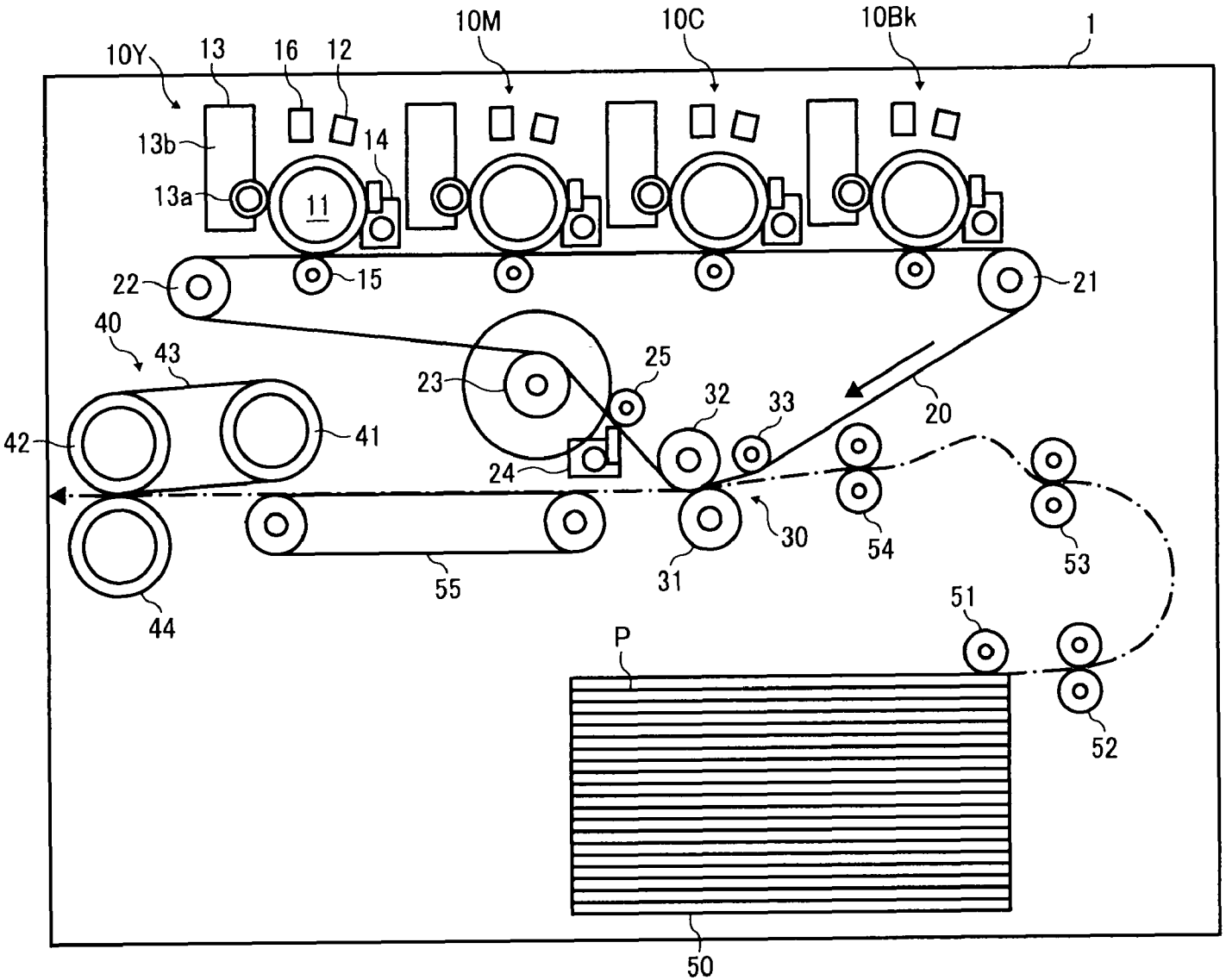
FIG. 1 is a schematic diagram illustrating an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, a printer as one example of an image forming apparatus according to an illustrative embodiment of the present invention is described.

Referring now to FIG. 1, there is provided a schematic diagram illustrating an image forming apparatus 1, according to the illustrative embodiment. The image forming apparatus 1 is a tandem-type full-color image forming apparatus using an electrophotographic method. Four image forming units 10Y, 10M, 10C, and 10Bk are aligned in tandem along an upper periphery of an intermediate transfer belt 20 serving as an image bearing member. A description of the intermediate transfer belt 20 is provided later with reference to FIG. 2.

The image forming units 10Y, 10M, 10C, and 10Bk all have the same configuration as all the others, differing only in the color of toner employed. Thus, a description is provided of the image forming unit 10Y as an representative example. To simplify the description, the reference characters Y, M, C, and BK indicating colors are omitted herein. It is to be noted that reference characters Y, C, M, and BK denote colors yellow, cyan, magenta, and black, respectively.

Each of the image forming units 10 includes a photoreceptor drum 11 serving as an image bearing member. Around the photoreceptor drum 11, a charging device 12, a developing device 13, a cleaning device 14, and so forth are provided. A primary transfer roller 15 is provided in an inner loop of the intermediate transfer belt 20 facing the photoreceptor drum 11.

According to the illustrative embodiment, each of the image forming unit 10 includes an exposure device 16 such as an LED. The exposure device 16, the charging device 12, and the developing device 13 are arranged such that the exposure device 16 can perform optical writing between the charging device and the developing device 13.

As an exposure mechanism, an exposure device common to all the image forming units 10 can be used. For example, a laser writing unit can be used.

In FIG. 1, the image forming apparatus 1 includes a transfer roller 31, an opposing roller 32 serving as a backup roller, a pair of registration rollers 54 serving as sheet feeding device, and the transport belt 55. The transfer roller 31 serves as a transfer member and is provided opposite the opposing roller 32 via the intermediate transfer belt 20. The opposing roller 32 is one of support members for the intermediate transfer belt 20 and serves as a backup. In FIG. 1, the pair of the registration rollers 54 is provided at the right side. The transport belt 55 is provided at the left side.

Substantially at the left of the transport belt 55, a fixing device 40 is provided. The fixing device 40 is a belt-type fixing unit that includes a heating roller 41, a fixing roller 42, a fixing belt 43 and a pressure roller 44. The fixing belt 43 is wound around and stretched between the heating roller 41 and the fixing roller 42. The pressure roller 44 presses against the fixing roller 42 through the fixing belt 43.

Substantially at the bottom of the image forming apparatus 1, a sheet tray 50 is provided to store recording media sheets P. A pick-up roller 51 and a separation roller 52 serving as a sheet feeding mechanism are also provided.

A transport roller 53 is provided at a suitable place in a sheet transport path indicated by a dotted line. Although not illustrated, a sheet guide is provided as necessary. Alternatively, also as necessary, a manual sheet feeder, a sheet reverse device, a scanner, an automatic document feeder (ADF) can be provided.

A description is now provided of image forming operation. The photoreceptor drum 11 of the image forming unit 10 is rotated in a counterclockwise direction by a drive mechanism, not illustrated. The surface of the photoreceptor drum 11 is uniformly charged to a predetermined polarity by the charging device 12. The charged surface of the photoreceptor drum 11 is illuminated with a scan light from the exposure device 16 based on image information, thereby forming an electrostatic latent image on the surface of the photoreceptor drum 11.

The image information exposed against the photoreceptor drum 11 consists of a single-color image information of yellow, magenta, cyan, and black. The electrostatic latent image of respective color is formed on each of the photoreceptor drum 11.

The developing device 13 supplies the respective color of toner to the electrostatic latent image, thereby forming a visible image, also known as a toner image.

In each of the image forming unit 10, while the intermediate transfer belt 20 is rotated in a clockwise direction, the primary transfer roller 15 transfers overlappingly the toner image of respective color from the photoreceptor drum 11 onto the intermediate transfer belt 20. The toner images of different colors of toner are overlappingly transferred, thereby forming a composite color toner image on the surface of the intermediate transfer belt 20.

It is to be noted that when forming a single-color image, one of the image forming units 10 can be used. When forming a two- or three-color image, a plurality of the image forming units 10 are used. When forming a monochrome image, the image forming unit 10Bk for the color black at the rightmost side in FIG. 1 can be used among four image forming units.

Toner remaining on the surface of the photoreceptor drum 11 (residual toner) after the toner image is transferred is removed by the cleaning device 14. Then, the surface potential of the surface of the photoreceptor is initialized by a charge neutralizing device in preparation for the subsequent image forming operation.

When the recording medium is fed from the sheet tray 50, the pair of the registration rollers 54 sends out the recording medium to a secondary transfer position 30 in appropriate timing such that the recording medium is aligned with the toner image formed on the intermediate transfer belt 20.

The transfer roller 31 serving as a secondary transfer mechanism transfers the toner image on the surface of the intermediate transfer belt 20 onto the recording medium. The recording medium bearing the toner image on the surface thereof is transported to the fixing device 40 by the transport belt 55. As the recording medium passes the developing device 40, heat and pressure are applied to the toner image on the recording medium, thereby fusing and fixing the toner image onto the recording medium. When the toner image is fixed on the recording medium, the recording medium is discharged onto a sheet discharge tray (not illustrated).

Figure 2:
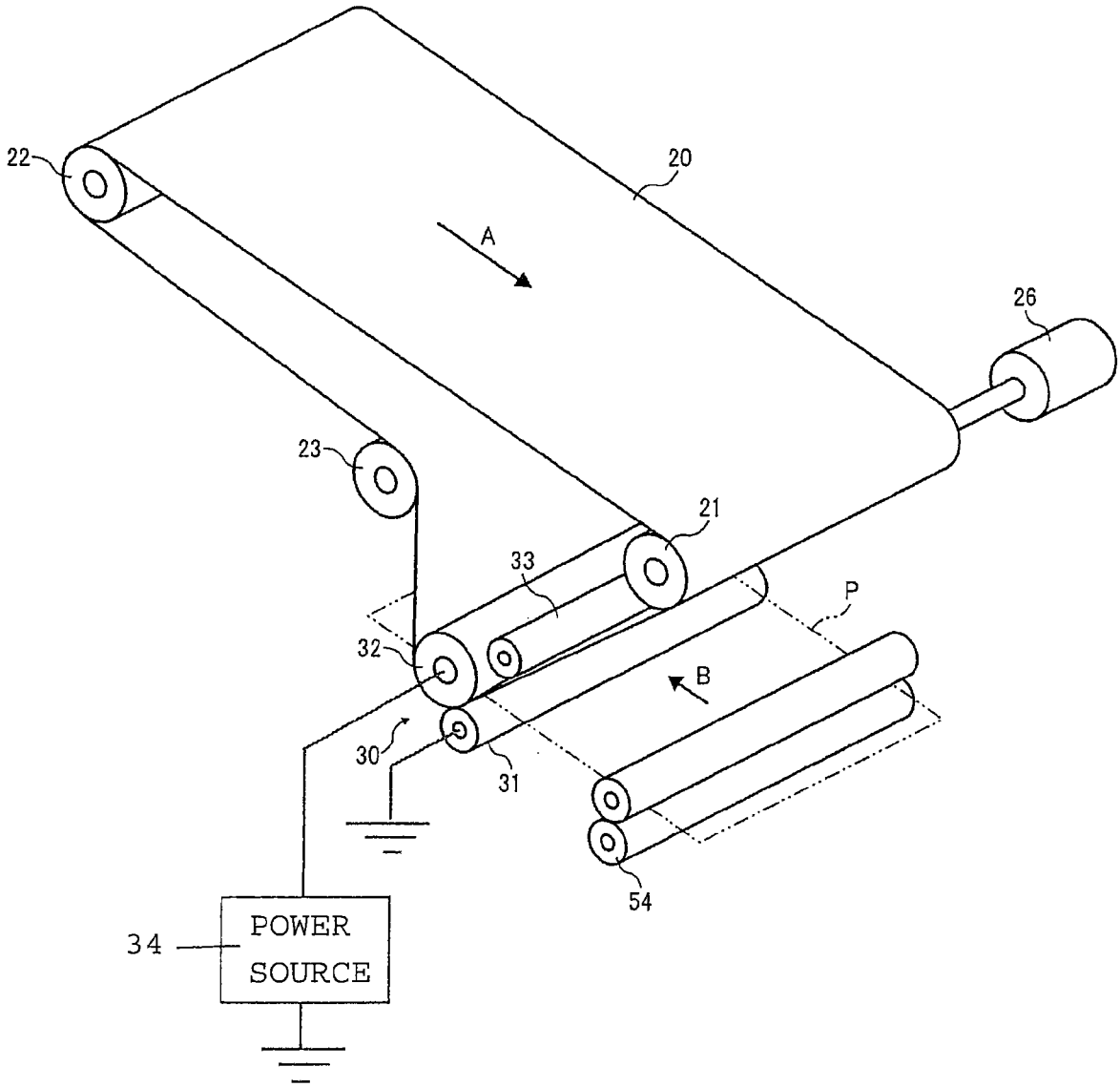
FIG. 2 is a perspective view of an intermediate transfer belt according to an illustrative embodiment of the present invention.

Referring now to FIG. 2, there is provided a perspective view of the intermediate transfer belt 20. As illustrated in FIG. 2, the intermediate transfer belt 20 is stretched between a drive roller 21, a driven roller 22, a stretch roller 23, the opposing roller 32, and a transfer guide roller 33. As the drive roller 21 is rotated by a motor 26, the intermediate transfer belt 20 moves in a direction of arrow A.

The driven roller 22 exerts tension to the intermediate transfer belt 20 through a weight application mechanism, not illustrated, thereby generating frictional transport force between the drive roller 21 and the intermediate transfer belt 20.

As described above, each of the photoreceptor drums 11 of the image forming units 10 is aligned along the outer surface of the intermediate transfer belt 20, that is, the belt surface stretched by the drive roller 21 and the driven roller 22. The primary transfer rollers 15 are arranged in the inner loop of the intermediate transfer belt 20 facing each of the photoreceptor drums 11.

Substantially below the opposing roller 32, the transfer roller 31 is provided and pressed by the opposing roller 32 through the intermediate transfer belt 20. The opposing roller 32 is supplied with a predetermined high voltage from a transfer power source 34. Subsequently, a transfer electric field is formed in the transfer nip where the transfer roller 31, electrically grounded, and the opposing roller 32 meet and press against each other.

The transfer roller 31 sandwiches the recording medium with the opposing roller 32 and the intermediate transfer belt 20 with a predetermined pressure, thereby transporting the recording medium.

Furthermore, the transfer guide roller 33 is provided in the inner loop of the intermediate transfer belt 20 and in the vicinity of the upstream of the opposing roller 32 in the direction of rotation of the belt. The transfer roller 31, the opposing roller 32, and the transfer guide roller 33 form the secondary transfer portion 30.

As can be understood from FIG. 1, the transfer guide roller 33 is provided slightly outside a straight line connected from the drive roller 21 to the opposing roller 32 so as to push the intermediate transfer belt 20 from the inner loop of the belt to outside. Accordingly, after the intermediate transfer belt 20 rolls on the transfer roller 31, the intermediate transfer belt 20 is sandwiched in the transfer nip formed between the transfer roller 31 and opposing roller 32.

Furthermore, the trailing edge of the recording medium approaches the surface of the intermediate transfer belt 20 using the rigidity of the recording medium more than the portion of the recording medium which is sandwiched in the transfer nip.

Although not illustrated in FIG. 2, a belt cleaning device 24 (shown in FIG. 1) is provided at the outer loop of the intermediate transfer belt 20 between the opposing roller 32 and the stretch roller 23. A roller 25 is provided to the inner loop of the intermediate transfer belt 20 to correspond to a cleaning blade of the belt cleaning device 24.

The recording medium P in FIG. 2 is transported in a direction of arrow B and aligned by the registration rollers 54. Subsequently, as the recording medium is transported between the transfer roller 31 and the intermediate transfer belt 20, the toner image on the intermediate transfer belt 20 is electrostatically transferred on to the recording medium.

Figure 3:
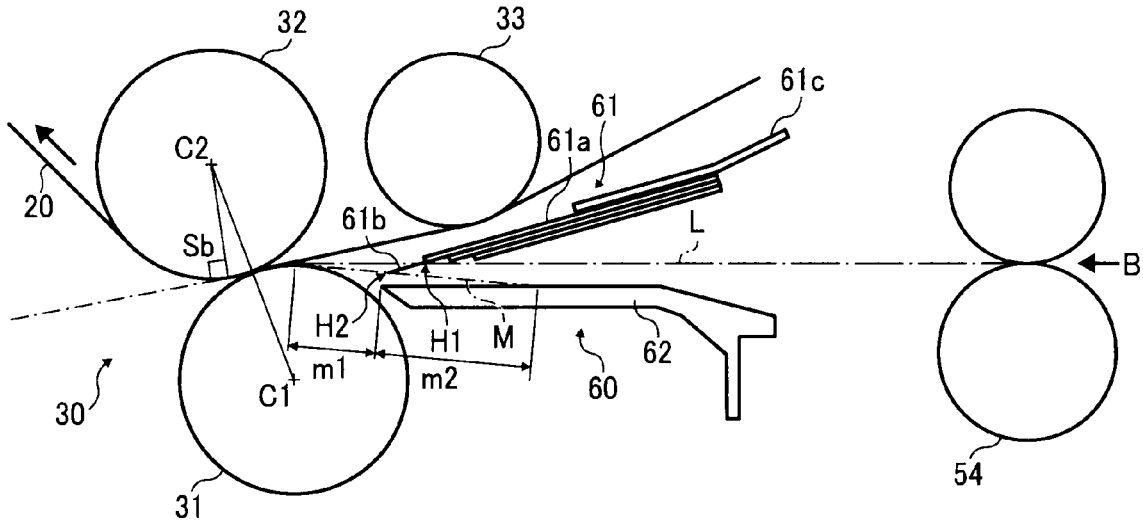
FIG. 3 is an enlarged view of a secondary transfer portion according to an illustrative embodiment of the present invention.

Referring now to FIG. 3, there is provided an enlarged view of the secondary transfer portion 30. According to the illustrative embodiment, the transfer roller 31, the opposing roller 32, and the transfer guide roller 33 form the secondary transfer portion 30.

The pair of the registration rollers 54 is provided at a sheet entering side of the secondary transfer portion. The pair of the registration rollers 54 serves as the recording medium feeding member (recording medium transport member) that sends the recording medium to the secondary transport portion at a proper timing. The pair of registration rollers 54 sandwich the recording medium at a predetermined pressure and transports the recording medium in a direction of arrow B.

According to the illustrative embodiment, as illustrated in FIG. 3, a sheet transport guide unit 60 includes an upper guide member 61 and a lower guide member 62.

The upper guide member 61 serving as a guide plate is provided substantially at the intermediate transfer belt side. The upper guide member 61 includes a first sheet member 61*a*, a second sheet member 61*b*, and a holding member 61*c* formed of a rigid body. An end portion H1 of the first sheet member 61*a* is located substantially on a straight line L connected from an end portion of a registration nip between the registration rollers 54 to a nip beginning portion between the transfer roller 31 and the opposing roller 32. In FIG. 3, the straight line L is a hypothetical sheet traveling path that assumes that the recording medium fed from the registration rollers 54 does not bend or deformed due to its selfweight so that the recording medium is transported linearly.

The position of the registration rollers 54 and the secondary transfer portion 30 in a vertical direction is configured such that the intermediate transfer belt 20 starts to contact the transfer roller 31 on the straight line L.

According to the illustrative embodiment, the first and the second sheet members 61*a* and 61*b* are adhered to the holding member 61*c* such that the first and the second sheet members 61*a* and 61*b* project from the holding member 61*c* toward the secondary transfer portion 30.

Figure 4:
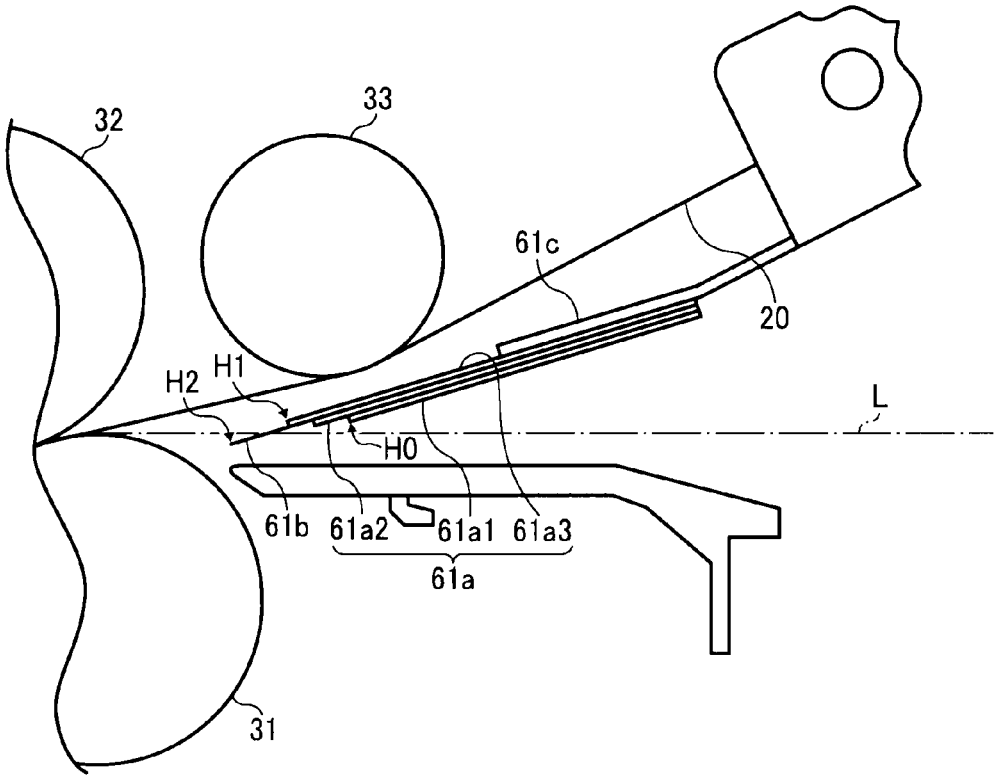
FIG. 4 is an enlarged view of an upper guide member according to an illustrative embodiment of the present invention.

Referring now to FIG. 4, there is provided an enlarged view of one example of the first sheet member 61*a* and the second sheet member 61*b*. The first sheet member 61*a* and the second sheet member 61*b* are formed of four layers of flexible sheets made of popolyethylene terephthalate (PET), for example.

The first sheet member 61*a* includes three flexible sub-sheets 61*a*1, 61*a*2, and 61*a*3. The sub-sheets 61*a*1, 61*a*2, and 61*a*3 are relatively thick and provided one on top of another such that the tips thereof are offset from one another at different positions. That is, the tip that is closest to the holding member 61*c* projects furthest toward the secondary transfer portion. In this case, the tip of the sub-sheet 61*a*3 projects furthest to the secondary transfer portion 30 among other sheets 61*a*1 and 61*a*2.

The second sheet member 61*b* is relatively thin and provided between the sub-sheet 61*a*3 closest to the holding member 61*c* and the sub-sheet 61*a*2 that is second closest to the holding member 61*c*. The second sheet member 61*b* projects furthest toward the secondary transfer portion 30 among other sheets 61*a*1, 61*a*2, and 61*a*3.

The sub-sheets 61*a*1 and 61*a*2, the second sheet member 61*b*, and the sub-sheet 61*a*3 are arranged in this order furthest from the holding member 61*c*. The sub-sheets 61*a*1 and 61*a*2, the second sheet member 61*b*, and the sub-sheet 61*a*3 are hereinafter referred to as a first sheet 61*a*1, a second sheet 61*a*2, a third sheet 61*b*, and a fourth sheet 61*a*3, respectively. Each of the first, the second, the third, and the fourth sheets 61*a*1, 61*a*2, and 61*b*, and 61*a*3, respectively, is substantially rectangular, and the width thereof is the same. The tips thereof are at different positions as illustrated in FIG. 4.

According to the illustrative embodiment, the projecting portions of the sheet members 61*a* and 61*b* projecting from the holding member 61 toward the secondary transfer portion 30 includes four flexible sub-portions. The bend-stiffness per unit area of the four flexible sub-portions (the projecting portions) are different and decreased toward the downstream in the sheet guide direction.

In other words, the front end consists of the relatively thin third sheet 61*b* alone, a combination of the third sheet 61*b* and the fourth sheet 61*a*3, a combination of the second sheet 61*a*2, the third sheet 61*b*, and the fourth sheet 61*a*3, and a combination of all four sheets.

The bend-stiffness per unit area of these portions is reduced toward the vicinity of the secondary transfer portion 30, that is, the downstream in the sheet guide direction. It is to be noted that it is desirable to adhere the surfaces of the neighboring sheets.

A tip H2 of the third sheet 61*b* is opposite the intermediate transfer belt 20 via the sheet transport path and the straight line L. The tip H0 of the first sheet 61*a*1, closest to the holding member 61*c*, among the four flexible sub-portions is located closer to the intermediate transfer belt 20 than the straight line L. In FIG. 4, the tip H1 of the fourth sheet 61*a*3, that is, the second tip from the most frontal tip H2 among the four flexible sheets is located on the straight line L.

As described above, the third sheet 61*b* having the stiffness lower than that of the tip H1 projects toward the secondary transfer portion 30 more than the tip H1 of the fourth sheet 61*a*3 provided at the upstream side in the direction of sheet guide. The bend-stiffness of the tip H1 of the fourth sheet 61*a*3 in the direction of the intermediate transfer belt 20 (a normal line direction relative to the sheet surface) is relatively large and greater than that of the third sheet 61*b*.

Furthermore, the tip H2 of the third sheet 61*b* at the secondary transfer portion 30 side has low stiffness and is opposite the intermediate transfer belt 20 beyond the straight line L. With this configuration, the transport direction of the recording medium P sent from the pair of the registration rollers 54 is regulated in the direction of the transfer roller 31 opposite the intermediate transfer belt 20, thereby preventing the front end of the recording medium P from directly hitting the intermediate transfer belt 20.

As a result, undesirable movement, for example, flapping of the recording medium P immediately after hitting the intermediate transfer belt 20 can be prevented so that the toner image on the intermediate transfer belt 20 is not scattered. Thus, stable transfer of the toner image is achieved, resulting in high imaging quality.

It is to be noted that when the tip H1 of the fourth sheet 61*a*3 at the upstream side in the sheet guide direction has relatively high stiffness and is disposed more toward the transfer roller side opposite the intermediate transfer belt 20 than the straight line L, the recording medium is reliably regulated. Although advantageous, such a configuration suffers from a drawback in that the sheet transport path of the recording medium P is significantly curved. Therefore, it is desirable that the tip H1 be disposed not exceeding the straight line L.

As illustrated in FIG. 3, a straight line M comprises a tangent line (length m1) from the tip H2 of the third sheet 61*b* having low-stiffness to the transfer roller 31 and a line (length m2) that is an extension of the tangent line to the lower guide member 62. It is desirable that the length m1 is substantially shorter than the length m2.

With this configuration, the recording medium P is prevented from contacting the intermediate transfer belt 20 when the recording medium P is deformed in a projecting manner in the direction of the intermediate transfer belt 20 due to a difference in peripheral velocity of the pair of the registration rollers 54 and the transfer roller 31 after the recording medium is sandwiched between the transfer roller 31 and the opposing roller 32. As a result, the toner image on the intermediate transfer belt 20 is not disturbed, thereby enabling stable transfer of the toner image and thus achieving high imaging quality.

As illustrated in FIG. 3, it is desirable that the transfer roller 31 be electrically grounded, and a center of rotation C1 of the transfer roller 31 be substantially at the upstream side in the direction of sheet transport more than a vertical line C2-Sb from a center of rotation C2 of the opposing roller 32 to the intermediate transfer belt 20 stretched by the opposing roller 32 and the transfer guide roller 33.

With this configuration, the recording medium P is transported while the transfer roller 31 presses the recording medium P and the intermediate transfer belt 20 at a predetermined pressure so that the recording medium P and the intermediate transfer belt 20 are stably kept in contact with each other.

Subsequently, the recording medium is nipped between the transfer nip portion applied with the transfer bias. The transfer nip portion is the place where the opposing roller 32 and the transfer roller 31 meet and press each other. Accordingly, image failure caused by electric discharge in tiny gaps can be prevented, thereby enabling stable transfer of the toner image and thus achieving high imaging quality.

As described above, according to the illustrative embodiment, the portion of the sheet members 61*a* and 61*b* projecting from the holding member 61*c* toward the secondary transfer portion 30 can easily bend at the tip thereof.

With this configuration, as will be later described with reference to FIGS. 5 and 6, in a case in which the front end of the recording medium P hits the portion of the upper guide member 61 further upstream than the tip of the upper guide member 61, that is, the sheet member 61*a* further upstream than the third sheet 61*b* alone and/or in a case in which the recording medium P is deformed and presses against the upstream portion of the sheet member 61*a*, the recording medium is prevented from flapping.

Furthermore, the trailing edge of the recording medium P can be prevented from hitting the intermediate transfer belt 20 as the trailing edge of the recording medium separates from the upper guide member 61. Accordingly, the recording medium can be stably transported.

It is to be noted that for the flexible sheets 61*a*1, 61*a*2, 61*a*3, and 61*b*, a flexible sheet that has proper flexibility while it can regulate the recording medium is used.

Figure 5:
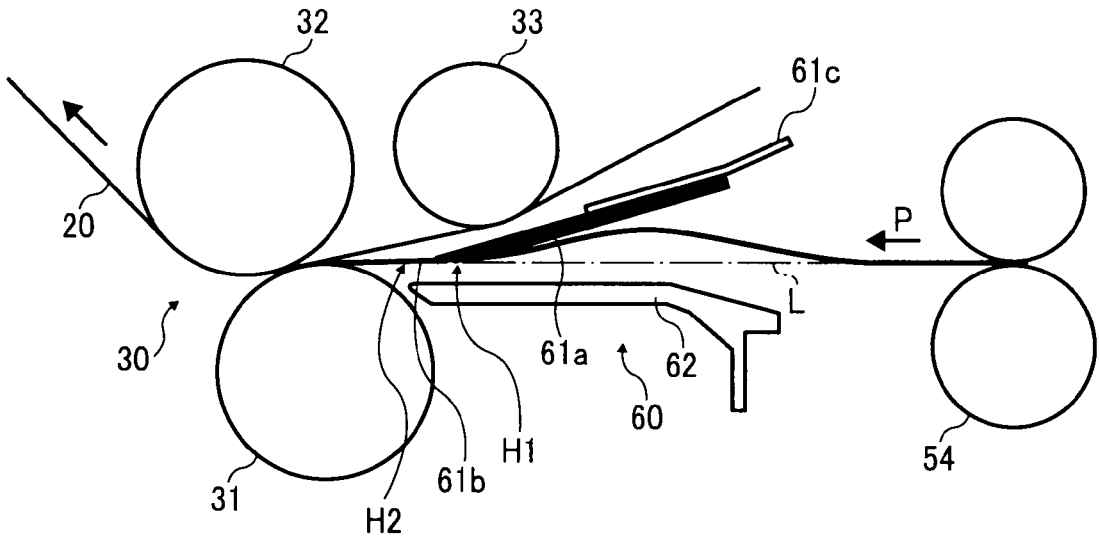
FIG. 5 is an enlarged view of a recording medium deformed before the secondary transfer portion.

Referring now to FIG. 5, there is provided a diagram schematically illustrating the recording medium P that is deformed in the vicinity of the secondary transfer portion. In FIG. 5, after the recording medium P sent from the pair of the registration rollers 54 is sandwiched by the transfer roller 31 and the opposing roller 32, the recording medium P is bent due to the difference in the peripheral velocity between the pair of the registration rollers 54 and the transfer roller 31.

In general, the peripheral velocity of the pair of the registration rollers 54 is faster than that of the transfer roller 31 by a few percent. Consequently, the recording medium P is bent between the secondary transfer portion 30 and the registration rollers 54 after the recording medium P is sandwiched by the transfer roller 31 and the opposing roller 32.

According to the illustrative embodiment, the bend-stiffness per unit area of the tip of the third sheet 61*b* alone is the smallest. Accordingly, even if the distance between the tip H2 and the transfer nip portion is short, the sheet transport path is not excessively and rapidly curved when compared with a sheet member having a relatively high bend-stiffness. Thus, it is possible to provide the tip H2 closed to the transfer nip portion. In other words, the distance between the tip H2 and the transfer nip portion can be short.

With this configuration, when the distance is short, an amount of the recording medium P between the tip H2 and the transfer nip portion is short, thereby increasing rigidity of the recording medium P at this place and thus preventing deformation of the recording medium P toward the opposing roller 32. As a result, deformation of the recording medium P due to the difference in the peripheral velocity between the pair of the registration rollers 54 and the transfer roller 31 is difficult to occur, thereby reducing a possibility of the recording medium P contacting the intermediate transfer belt 20. Thus, the toner image on the intermediate transfer belt 20 is not disturbed, enabling stable transfer of the toner image and thus achieving high imaging quality.

Figure 6:
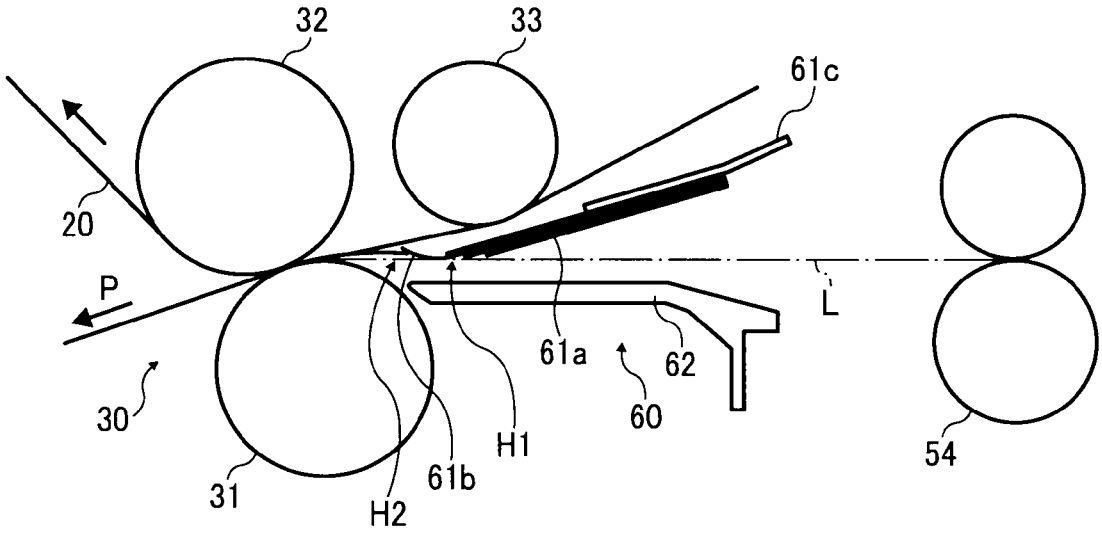
FIG. 6 is an enlarged view of a recording medium deformed immediately before the trailing edge of the recording medium separates from the upper guide member of FIG. 4.

Referring now to FIG. 6, there is provided a diagram schematically illustrating the recording medium P that is deformed immediately before the trailing edge of the recording medium P separates from the third sheet 61*b* that is flexible and has relatively low stiffness.

In a case in which the recording medium P has high stiffness, as the trailing edge of such a recording medium P separates from the upper guide member 61, it is possible that the rigidity of the recording medium accumulated during bending is released and the trailing edge of the recording medium P strikes the intermediate transfer belt 20, thereby scattering the toner image on the intermediate transfer belt 20.

By contrast, according to the illustrative embodiment, the bend-stiffness per unit area is less toward the tips of the sheet members 61*a* and 61*b* compared with the portion of the sheet members at the upstream in the sheet guide direction. Therefore, the tips can flex well.

With this configuration, as the trailing edge of the recording medium P separates from the upper guide member 61, the tip portion of the sheet members 61*a* and 61*b* flexes so as to reduce the rigidity of the recording medium P while an amount of the recording medium being deformed is also reduced.

As a result, the trailing edge of the recording medium P is prevented from striking the intermediate transfer belt 20, thus preventing the toner image on the intermediate transfer belt 20 from scattering.

In view of reduction of rigidity of the recording medium P, as illustrated in FIG. 4, the portion of the sheet member 61*b* that projects beyond the straight line L is only the portion having the smallest bend-stiffness per unit area.

Figure 7:
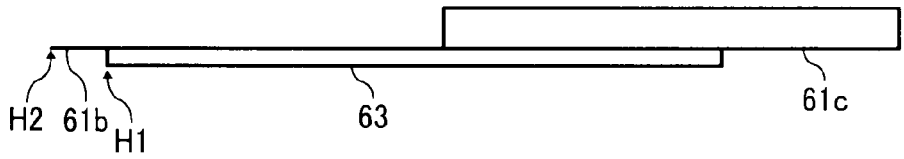
FIG. 7 is a side view of the upper guide member according to another embodiment of the present invention.

Referring now to FIG. 7, there is provided a side view of the upper guide member 61 according to another embodiment of the present invention. As illustrated in FIG. 7, two flexible sheets 63 and 61*b* are provided such that the tips thereof are at different positions and project from the upper guide member 61 formed of the rigid body.

According to the present embodiment, there are two flexible sub-portions having different bend-stiffness. In FIG. 7, the very front-end of the flexible sub-portion, in this case, the tip portion of the sheet member 61*b*, is formed of a relatively thin flexible sheet.

When there are only two flexible sub-portions having different bend-stiffness per unit area compared with three flexible sub-portions or more, it is difficult to achieve flexibility at the tip portion and rigidity substantially at the upstream in the sheet guide direction at the same time. Consequently, it is necessary to precisely set a positional relation of the tip H2 and the tip H1 having relatively high bend-stiffness relative to the sheet transport path (the straight line L).

In particular, the tip H2 is disposed at the transfer roller side, beyond the straight line L. In other words, the tip H2 is disposed opposite the side to which the recording medium should not advance. For example, in FIG. 3, the tip H2 is disposed opposite the intermediate transfer belt 20 that is where the recording medium should not contact. By contrast, the tip H1 is disposed on the straight line L or at the side where the tip H1 needs to reliably prevent the recording medium from advancing.

Figure 8:
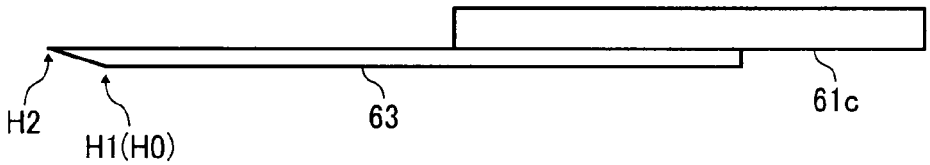
FIG. 8 is a side view of the upper guide member according to yet another embodiment of the present invention.

Referring now to FIG. 8, there is provided a cross-sectional view of the upper guide member 61 according to yet another embodiment of the present invention. According to the present embodiment, a cross sectional area of the flexible sheets 63 in the direction of sheet transport is reduced so as to reduce the bend-stiffness per unit area of cross section.

According to the present embodiment, the tip portion of the sheet 63 is cut into a tapered shape in cross section. The starting point of the cut coincides with the tip H1 having large bend-stiffness per unit area relative to the tip portion where the cross sectional area is continuously reduced. Also, the starting point of the cut coincides with the tip H0 closest to the holding member 61*c* in the sheet guide direction among the other flexible sub-portions having different bend-stiffness per unit area. With this configuration, when the cross-sectional area is different, it is not necessary to increase the number of the sheet members.

Figure 9:
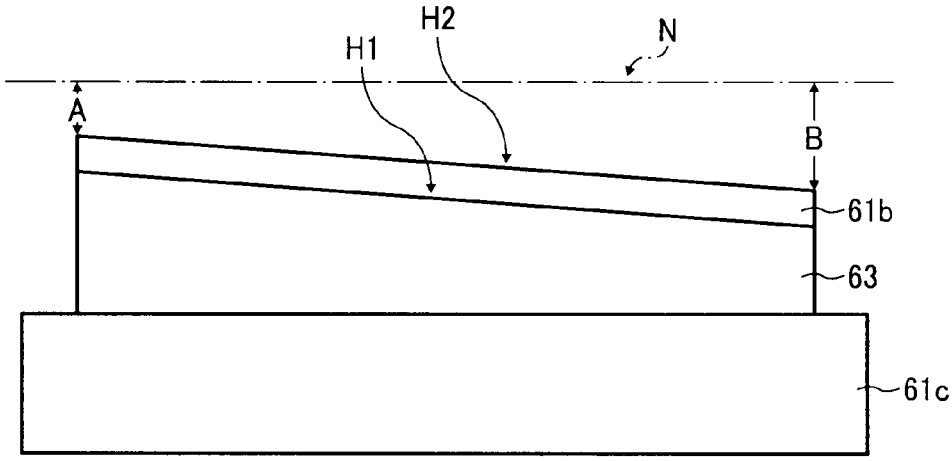
FIG. 9 is a side view of the upper guide member according to yet still another embodiment of the present invention.

Referring now to FIG. 9, there is provided a top view of the upper guide member 61 according to yet still another embodiment of the present invention. According to the present embodiment, the bend-stiffness per unit area is changed in the sheet guide direction. The present embodiment can be applied to configurations illustrated in FIGS. 4, 7, and 8.

According to the present embodiment, the distance between the start of the transfer nip N (the position of contact between the straight line L and the transfer roller 31) and the tip H2, and between the start of the transfer nip N (the position of contact between the straight line L and the transfer roller 31) and the tip H1 of the flexible sub-portion at the upstream in the sheet guide direction in the vicinity of the tip H2 are different in accordance with the position in the width direction perpendicular to the sheet guide direction.

In particular, the tips H1 and H2 are oblique such that the distance between the start of the nip N and the left end is the shortest as indicated by arrow A, and the distance between the start of the nip N and the right end is the longest as indicated by arrow B. Accordingly, the trailing edge of the recording medium separates gradually from the upper guide member 61 in a direction of a shaft of the transfer roller, thereby mitigating the impact of the trailing edge of the recording medium striking the intermediate transfer belt 20, and thus reliably transporting the recording medium.

Figure 10:
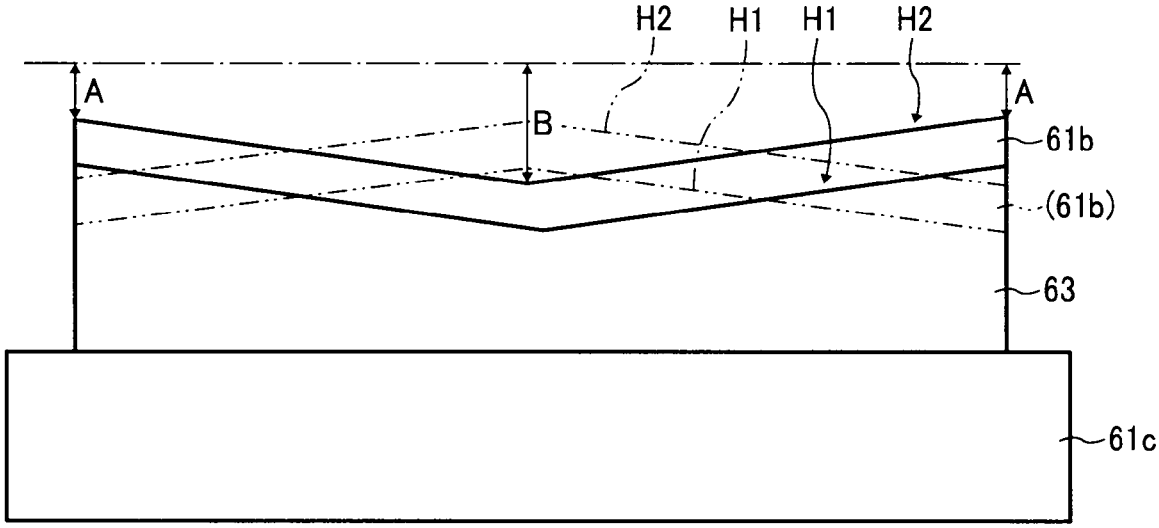
FIG. 10 is a top view of the upper guide member according to yet still another embodiment of the present invention.
Figure 11:
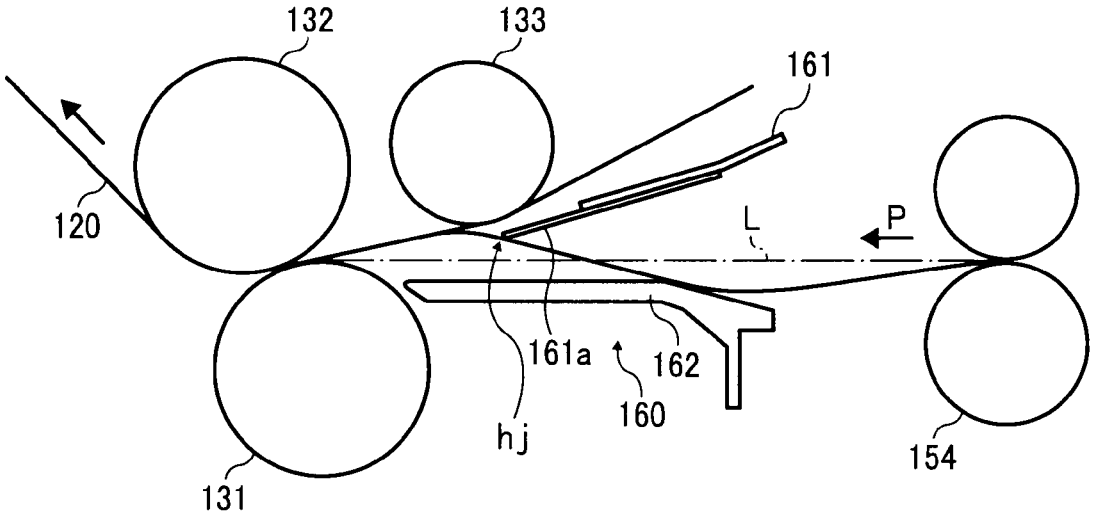
FIG. 11 RELATED ART
FIG. 11 is a cross-sectional view of a second transfer portion of a related-art image forming apparatus.

Referring now to FIG. 10, there is provided a top view of the upper guide member 61 according to yet still another embodiment of the present invention.

In FIG. 10, a solid line indicates an example in which the distance between the start of the transfer nip N, and the tip H2 and the tip H1 is the longest at the center in the width direction as indicated by arrow B. The distance is reduced toward the lateral sides of the upper guide member 61 as indicated by arrow A.

By contrast, a dashed line indicates an example in which the distance between the start of the transfer nip N, and the tip H2 and the tip H1 is the shortest at the center in the width direction. The distance increases toward the lateral sides of the upper guide member 61.

In both examples, similar to the illustrative embodiment illustrated in FIG. 9, the trailing edge of the recording medium gradually separates from the upper guide member 61 in the direction of the shaft of the transfer roller, thereby mitigating the impact of the trailing edge of the recording medium striking the intermediate transfer belt 20, and thus reliably transporting the recording medium.

According to the illustrative embodiment, the transport direction of the recording medium P sent from the pair of the registration rollers 54 is adjusted substantially toward the transfer roller 31. Therefore, the front end of the recording medium is prevented from directly striking the intermediate transfer belt 20, thereby preventing the recording medium P from flapping and scattering the toner image on the intermediate transfer belt 20 and enabling stable transfer of the toner image. Accordingly, high imaging quality is achieved.

According to the illustrative embodiment, when the difference in the peripheral velocity between the pair of the registration rollers 54 and the transfer roller 31 causes the recording medium P to deform or bend after the recording medium is sandwiched in the transfer nip, the recording medium is prevented from bending in a protruding manner toward the intermediate transfer belt. Accordingly, the toner image on the intermediate transfer belt is not scattered, thereby allowing stable transfer of the toner image and obtaining a high-quality image without image failure.

Furthermore, according to the illustrative embodiment, the front end of the recording medium is prevented from hitting the intermediate transfer belt 20 while preventing the recording medium P from contacting the intermediate transfer belt 20 due to deformation of the recording medium P. Accordingly, the toner image on the intermediate transfer belt 20 is prevented from scattering, allowing stable transfer of the toner image onto the recording medium and obtaining a high-quality image without image failure.

Still further, according to the illustrative embodiment, the recording medium stably contacts the intermediate transfer belt 20 and is transported while the recording medium and the intermediate transfer belt 20 are applied with a predetermined pressure by the transfer roller 31. Subsequently, the recording medium is sandwiched in the transfer nip between the opposing roller 32 and the transfer roller 31 where transfer bias is applied. As a result, an image failure derived from electric discharge in tiny gaps can be prevented, allowing stable transfer of the toner image onto the recording medium and obtaining a high-quality image without image failure.

Furthermore, according to the illustrative embodiment, in a case in which the front end of the recording medium P hits the upper guide member 61 and/or when the recording medium P is deformed pressing the upper guide member 61 and the elastic energy of the recording medium P causes the recording medium P to leap and/or when the trailing edge of the recording medium hits the intermediate transfer belt as the trailing edge of the recording medium separates from the upper guide member, the impact of the recording medium P can be reduced, allowing stable transport of the recording medium.

The foregoing pertains to the illustrative embodiment of the present invention. However, the present invention is not limited to the configuration described above.

According to the illustrative embodiment, the present invention is employed in the tandem-type image forming apparatus. Arrangement of the image forming units in the tandem-type image forming apparatus is not limited to the configuration described above.

The image forming apparatus is not limited to the tandem type. The image forming apparatus includes a single photoreceptor drum surrounded by a plurality of developing devices, or a revolver-type developing device. The present invention can be also applied to a full-color image forming apparatus using three colors of toner and a multi-color image forming apparatus using two colors of toner.

Furthermore, the present invention can be applied to a sheet guide member that guides a recording medium to a transfer position when the image is directly transferred from a vented photoreceptor or a photoreceptor drum to the recording medium.

The present invention can be also applied to a case in which alignment of the trailing edge of the recording medium changes so that the recording medium hits the intermediate transfer belt and/or the photoreceptor when the trailing edge of the recording medium moves through the guide member immediately after the recording medium is free from the sheet guide member.

In addition, the present invention can be applied to a case in which alignment of the recording medium changes in a direction separating from the intermediate transfer belt and/or the photoreceptor causing various imaging failure. For example, according to the illustrative embodiment illustrated in FIG. 3, the recording medium is regulated so as to prevent the tip thereof from directly contacting the intermediate transfer belt 20 or to prevent the deformed recording medium from contacting the intermediate transfer belt 20. Alternatively, the present invention can be applied when the tip of the recording medium is prevented from directly contacting the transfer roller 31 so that the recording medium contacts the intermediate transfer belt and then advances into the nip portion between the transfer roller 31 and the intermediate transfer belt 20.

Furthermore, the present invention can be implemented in a case in which relatively high stiffness is needed for the guide member while low stiffness is desirable to regulate rapid alignment change when the trailing edge of the recording medium is guided.

According to the illustrative embodiment, the image forming apparatus includes, but is not limited to, a printer, a copier, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus for transporting a recording medium on which an image is formed, comprising:

a guide plate to guide the recording medium to a predetermined position in the image forming apparatus, the guide plate including a flexible sheet member and a rigid holding member to hold the flexible sheet member such that the flexible sheet member projects from a front end of the rigid holding member, wherein a projecting portion of the flexible sheet member includes at least three flexible sub-portions having different bend-stiffness per unit area from each other, and the bend-stiffness per unit area is reduced toward a downstream side in a sheet guide direction, wherein the at least three flexible sub-portions of the flexible sheet member comprise at least three flexible overlapping sub-sheets, tips of which are offset from one another at different positions, and wherein one of the flexible sub-sheets having the smallest bend-stiffness per unit area in the sheet guide direction is provided at a second sheet from an image bearing member side, and the tip of the second flexible sub-sheet projects furthest from a holding member side, while the tip of a first sheet from the image bearing side projects second furthest from the holding member.

2. The image forming apparatus according to claim 1, further comprising:

an image bearing member to bear an image;

a transfer member to transfer the image onto a recording medium; and a sheet feeding device provided substantially at an upstream side in a direction of sheet transport of the guide plate to feed the recording medium in the direction of sheet transport, wherein the guide plate guides the recording medium substantially from the image bearing member side to a transfer position located between the image bearing member and the transfer member, the tip of the sheet member is located opposite the image bearing member via a hypothetical sheet transport path that assumes that the recording medium is linearly transported to the guide plate by the sheet feeding device, and a tip of one of the flexible sub-portions closest to the holding member is on the sheet transport path or substantially at an image bearing side of the sheet transport path.

3. The image forming apparatus according to claim 2, further comprising, a backup member provided to the back side of the image bearing member and supplied with a voltage of the same polarity as that of toner used to form the image, wherein the image bearing member is a belt, the transfer member electrically grounded contacts the surface of the image bearing member at the transfer position, the transfer member and the backup member are provided such that after the image bearing member is wound around the surface of the transfer member the transfer member and the backup member sandwich the recording medium in a transfer nip therebetween, and the trailing edge of the recording medium not sandwiched approaches the surface of the image bearing member due to rigidity of the recording medium.

4. The image forming apparatus according to claim 1, wherein the at least three flexible sub-portions are formed such that an overall thickness of the flexible sheet member is reduced toward the downstream side in the sheet guide direction.

5. The image forming apparatus according to claim 1, wherein a distance from the tip of the sheet member to the predetermined position in the image forming apparatus and a distance from the tip of the flexible sub-portion in the vicinity of the sheet member to the predetermined position in the image forming apparatus change with position in the width direction perpendicular to the sheet guide direction.

* * * * *